United States Patent [19]

Boeckmann et al.

[11] Patent Number: 5,023,122

[45] Date of Patent: Jun. 11, 1991

[54] EASY OPEN BAG STRUCTURE

[75] Inventors: Hugo Boeckmann, Arlington Heights; Donald L. Van Erden, Wildwood, both of Ill.

[73] Assignee: Minigrip, Inc., Orangeburg, N.Y.

[21] Appl. No.: 363,771

[22] Filed: Jun. 9, 1989

Related U.S. Application Data

[63] Continuation-in-part of Ser. No. 150,229, Jan. 29, 1988, Pat. No. 4,846,585.

[51] Int. Cl.[5] ..... B65D 65/28

[52] U.S. Cl. ..... 428/43; 24/576; 24/587; 428/99; 428/100; 156/66; 156/256; 156/244.25

[58] Field of Search ..... 156/66, 256, 261, 244.25; 383/5, 63; 428/99, 43, 100; 24/576, 587

[56] References Cited

U.S. PATENT DOCUMENTS 3,827,472 8/1974 Uramoto ..... 383/63 X

FOREIGN PATENT DOCUMENTS 1010738 11/1965 United Kingdom ..... 24/576

*Primary Examiner*—John J. Gallagher
*Assistant Examiner*—Mark A. Osele
*Attorney, Agent, or Firm*—Hill, Van Santen, Steadman & Simpson

[57] ABSTRACT

A reclosable plastic film for a bag and the method and mechanism for making the same. The film may be employed for making various types of bags, but in each case the arrangement provides for a tear strip wherein a series of perforations are placed in the film extending parallel to the fastener profiles, and a sealing cap layer is placed over the perforations which cap layer is grain oriented and sufficiently frangible so that as the film is torn along the line of perforations, the cap layer will tear, providing sealing until tearing occurs. A method and apparatus are provided wherein a completed film for a bag may be constructed in a single pass with the film first being perforated, the cap layer laid over the film while molten, and the profiles then attached to the film oriented relative to the location of the perforations.

19 Claims, 2 Drawing Sheets

EASY OPEN BAG STRUCTURE

BACKGROUND OF THE INVENTION

This application is a continuation-in-part of U.S. Ser. No. 150,229, Filed Jan. 29, 1988, now U.S. Pat. No. 4,846,585, Boeckmann et al, and of its divisional application, U.S. Ser. No. 306,101, Filed Feb. 6, 1989, Boeckmann et al, now abandoned.

The present invention relates to improvements in plastic bags and fasteners therefor, particularly to a method and mechanism for making a reclosable plastic film bag and for making plastic film material for making a bag with a hermetically sealing tear strip at the top which is removable for use of the bag.

In the manufacture of plastic film bags, reclosable rib and groove profile elements have been provided which permit a bag to be opened and reclosed. Where the bags are used for containing products such as foodstuffs, flaps above the rib and groove elements have been joined to hermetically seal the bag until such time when it is purchased and opened for use. To facilitate opening, parallel lines of tear perforations have been placed above the rib and groove profiles so that a strip can be torn from the top to free the flaps and permit opening the bag by pulling the rib and groove elements apart. The addition of perforations to allow tearing a strip off the top has been known in U.S. Pat. Nos. such as 3,172,443, 3,226,787, 3,473,589 and 4,589,145.

Such perforations destroy the hermetic seal of the bag and permit the passage of air. While the rib and groove elements below the perforations may be joined to close and seal the bag, these elements may inadvertently become separated during handling, storage and merchandising so that air can enter the bag via the perforation holes. Further, the rib and groove elements per se may not be sufficiently airtight. The need for airtight integrity is especially so where the contents of the bag must be protected against air, such as where a bag contains foodstuffs, and laminated films are required. The addition of such perforations creates a problem because the rib and groove elements below said perforations may not, as indicated, be sufficiently airtight, though they present the best method of tearing off the top of the bag for access to the rib and groove elements. Other means of providing tear strips have been attempted, but these are not as satisfactory as the relatively simple expedient of perforating the film of the flaps at the bag top. Such perforations can be added by perforation equipment which operates rapidly and satisfactorily.

An important element in the manufacture of reclosable bags of the type above described is the preparation or manufacture of the plastic film for the bags. In making such film, it is necessary to provide a single layer of multiple layer film and to have on the surface of the film profile elements which are accurately and carefully shaped so as to be able to interlock to each other. The profile elements are continuous in structure and are well adapted to being made by an extrusion process. The addition of structural requirements such as the provision of perforations and means for sealing the perforations creates a further manufacturing obligation which must be performed to complete an adequate film for the manufacture of bags.

It is accordingly an object of the present invention to provide a bag structure and method of making the structure where the bag has reclosable rib and groove elements at the top, the flaps are joined to each other so as to provide a hermetic seal, perforations are included to be able to readily tear a strip off the top and yet the perforations do not admit air so as to jeopardize the hermetic seal of the bag.

A further object of the invention is to provide an improved bag structure which provides a reopenable bag which is positively sealed up to the time that the customer or user purchases the bag and tears a strip off the top.

A further object of the invention is to provide an improved simplified bag structure which can be inexpensively made and which provides for a sealed bag which has a reopenable feature.

A further object of the invention is to provide an improved method wherein a plastic film material for making bags is prepared which has reclosable profile elements on the surface and which also has perforations to provide a tear strip for the finished bag where the perforations are temporarily sealed and the method of manufacture enables accomplishment of the complete preparation of the film in a single expedient sequence of steps.

A further object of the invention is to provide an improved apparatus for the preparation of a bag film wherein the completed film has reclosable profiles on the surface, has perforations for a tear strip in a finished bag and a removable seal over the perforations.

FEATURES OF THE INVENTION

The invention provides for a plastic film bag having confronting side walls sealed at their edges with a pressure interlocking reopenable rib and groove element extending along the top. Above the rib and groove elements are flaps which are doubled so as to be continuous and form a hermetically sealed bag. Alternately, such flaps can also be sealed together. The top can be ripped open by tearing a strip off the bag, and this is simply and economically provided for by parallel lines of perforation to provide a tear strip at the top that can be torn off the bag. In accordance with the invention, a perforation sealing means is attached to the film so that the perforations continue to perform their function of permitting a strip to be readily torn off the top but do not impair the hermetic integrity of the bag allowing it to be stored, handled and merchandised, assuring the purchaser that the contents continue to be protected and hermetically sealed. The bag in addition to providing a bag sealed up to the time that the user wishes to open it, provides a bag that is reclosable for use until the contents are fully removed.

A further feature of the invention resides in the manufacture of film for the bags wherein a web of film is continuously fed forwardly, plastic profiles are positioned onto the surface of the film by being extruded and attached in their tacky molten form. A row of tear perforations is positioned in the film in the same pass through mechanism which attaches the profiles, and a perforation seal strip is laid over the perforations essentially simultaneously with the attachment of the profiles.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
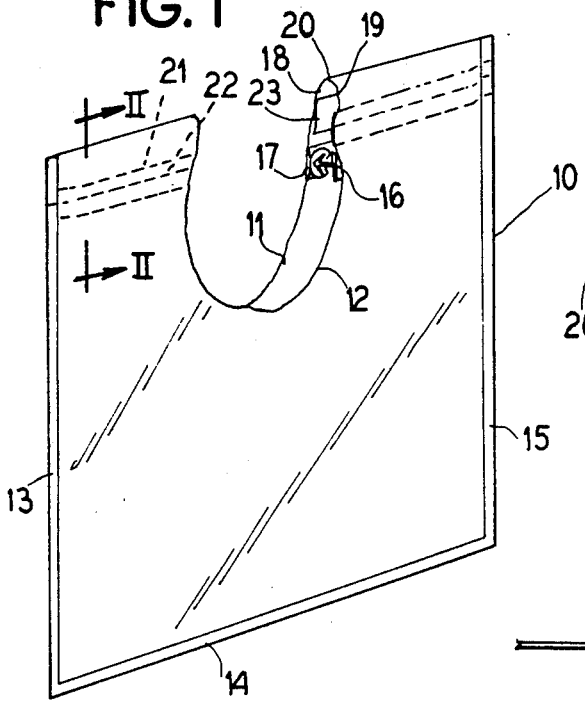
FIG. 1 is a perspective view, with portions broken away, of a bag constructed in accordance with the principles of the present invention.

FIG. 1 illustrates a formed plastic film bag of polyethylene or other plastic film with the bag shown at 10 having back and front walls 11 and 12. The walls of the bag are sealed at their edges forming side seams 13 and 15 and a bottom seam or fold 14.

Figure 2:
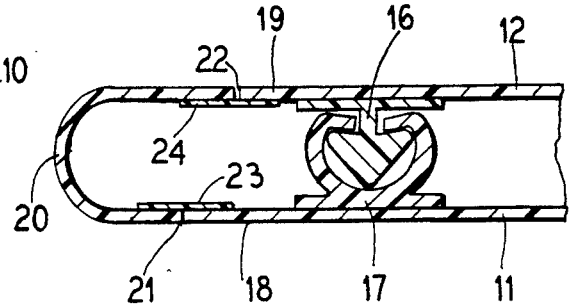
FIG. 2 is a vertical sectional view taken substantially along line II—II of FIG. 1.

Located on the confronting walls of the bag near the bag top, are shaped interlocking rib and groove profile elements with the rib shown at 16 and the groove at 17 as also illustrated in FIG. 2. The profiles may be attached to the inner surface of the film or be integral therewith. The rib and groove elements are shaped so as to be cooperative and be pressure interlocking to close the bag by applying a pressure along the profiles. The profiles can be separable for access to the contents of the bag by pulling apart flaps 18 and 19 which extend above the profiles. The flaps are shown as being integral with the side walls and for convenience, the flaps are doubled at the upper distal edge 20. By the doubling of the top, the bag is hermetically sealed until used. Alternately, the flaps could be separate and heat sealed together to create a hermetic seal. Thus, the flaps are joined to each other at the top edge of the bag, and in FIGS. 1 and 2 are joined by the plastic film being continuous or integral.

For access to the contents, a strip is torn off the top along perforated lines 21 and 22. The perforations are formed in the film so that the user may grasp the top strip between his thumb and forefinger and tear off the top. Opening flaps will remain which project above the profiles for grasping and opening the bag.

In order to provide for a removable tear strip at the top, lines of weakened tear resistance must be provided, and these are provided by the perforations 21 and 22. Advantages are attained in using perforations for the tear resistant lines in that the perforations can be easily provided by perforating tools in the manufacture of the bag, and the perforations do not substantially weaken the bag so that the top can be accidentally pulled off, but do provide a tear guideline so that the strip will separate along the predetermined line defined by the perforations when the top strip is torn off. This is particularly desirable where laminated films with strong tear resistance are used and where other means of removing a tear strip do not function satisfactorily.

For example, if no perforations are included, the hermetic integrity of the bag remains intact, but it becomes necessary to use a scissor or knife to cut off the tear strip. By placing the perforations, the tear strip is defined, but the hermetic seal afforded by the doubled top at 20 is broken.

A perforation sealing means is applied to the perforations preferably in the form shown by attaching frangible strips 23 and 24 to the inner surfaces of the film. Preferably, the strips are attached to the inner surface, but in some instances if it is desirable, the strips can be applied to the outer surfaces or both inner and outer surfaces. These frangible strips are of a lightweight material which will seal the small holes of the perforations and yet separate when the top strip is torn from the bag. While other mean may be provided for sealing the perforate holes, the preferred arrangement is by the attachment of the strips 23 and 24, and these are preferably attached to the inner surface of the film. By attachment to the inner surface, they are protected so that they are not accidentally peeled off of the film surface during handling or storage, and relatively lightweight material can be used impervious to air. Further, since the attachment of the strips is protected, the strips can be attached by a light bonding adhesive so that the bonding adhesive breaks when the top strip is torn off. One form contemplated is attaching one side of the strip by a strong adhesive and the other side by a weaker adhesive so that the strip will separate from the film along one side. The weaker adhesive would preferably be placed on the side of the strip adjacent the profiles 16 and 17.

Figure 4:
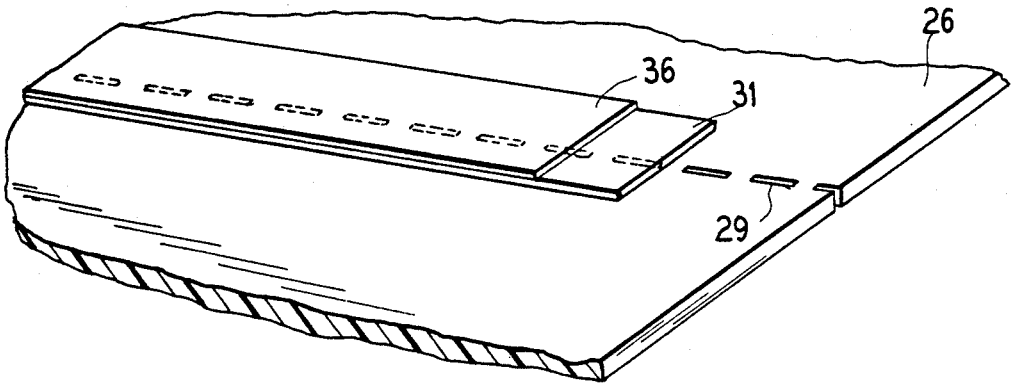
FIG. 4 is an enlarged fragmentary view of a portion of the sheet of film of FIG. 3.

The material of the strips can be thin film which provides adequate sealing of the openings or it can be of a material different than the film of the bag. By using a film considerably thinner or lighter weight than the film of the bag, effective sealing is obtained and yet the strips will tear. Or, a plastic can be used which is oriented so that it relatively easily tears laterally in the direction of the tear strip when it is pulled off. The strips 23 and 24 can be of a material which is readily frangible but which provides airtight sealing over the perforation holes. FIG. 4 shows a laminated strip having two components, one 31 for adhering the strip to the film and the other 36 for providing an air and moisture barrier such as a metal foil.

While a bag construction is shown wherein the top is integral with the walls of the bag, it will be understood that the principles of the concept may be utilized with a fastener which is secured to the top walls of a bag.

Figure 3:
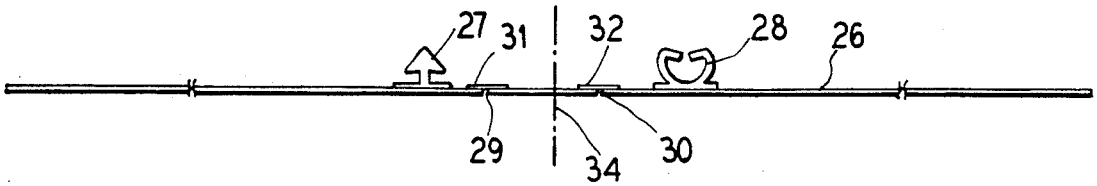
FIG. 3 is an elevational view taken from the side of a plastic sheet for forming the bag of FIG. 1.

FIGS. 3 and 4 illustrate steps of manufacture of the bag. A sheet of plastic film 26 is provided and fastener profiles 27 and 28 are attached to or integral with the upper surface of the film. Perforation lines 29 and 30 are then formed in the film with the perforation lines being parallel to and located between the profile elements 27 and 28. Sealing strips 31 and 32 are then laid over the top of the perforation holes. The sealing strips may be heat bonded to the plastic film 26 or the sealing strips 31 and 32 may be adhesive backed so that they are bonded to the surface of the film. The film is then folded about the line 34 with the ends brought together, the profiles 27 and 28 are interlocked, and the bag completed by forming the side and bottom seams shown at 13, 15 and 14 in FIG. 1. FIG. 4 illustrates the manner in which the sealing strip 31 is laid over the holes formed by the perforation line 29 in the film 26. The sealing strips may also be provided by extruding a thin layer of material over the perforations.

Figure 5:
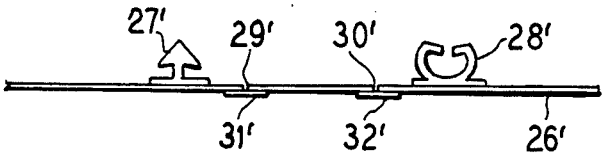
FIG. 5 is a fragmentary elevational view taken from the side of a plastic sheet for forming the bag showing a modified form.

FIG. 5 shows a modified form wherein a structure similar to FIG. 3 is used, but the strips are placed on the outer surface of the film. A film strip 26' has profiles 27' and 28' thereon. Also, perforations 29' and 30' extending through the film. Narrow strips 31' and 32' are attached to the outer surface of the film.

In use, the plastic bag 10 is positively hermetically sealed and protected against the ingress of air since the protective sealing strips 23 and 24 prevent air from penetrating through the holes of the perforations. The strips are physically protected by the outer layers of film. When the bag is to be used, the top is torn off with the tear following the perforation lines 21 and 22, and the thin sealing strips 23 and 24 will separate along the perforation lines inasmuch as they are of a lightweight frangible material. The resultant bag will then have flaps extending above the rib and groove elements so that the bag can be opened and reclosed for reuse. The remaining torn portions of the strip provide a better flap which is easier to grip for opening the bag by pulling apart the rib and groove elements. The remaining portions of the sealing strips also slightly stiffen the flaps.

Figure 6:
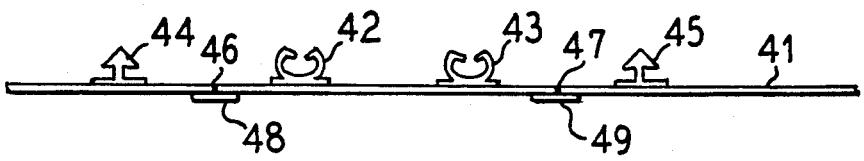
FIG. 6 is an end elevational view of a bag film prepared in accordance with the principles of the present invention.

FIG. 6 illustrates another arrangement, somewhat similar to FIG. 3, but showing the impervious cap layers placed on the outer surface of the film.

FIG. 6 illustrates a layer of bag making film 41 with groove profiles 42 and 43 on the upper surface. Outwardly therefrom are male arrowhead profiles 44 and 45 shaped to interlock with the profiles 42 and 43.

Perforate tear lines 46 and 47 are located between the profiles. On the lower or outer surface, impervious cap layers 48 and 49 are placed over the perforation lines to provide a moisture and air impervious seal for the perforate tear lines in the finished bag. The location of the tear lines 46 and 47 will be significant relative to the structure of the completed bag or package.

Figure 7:
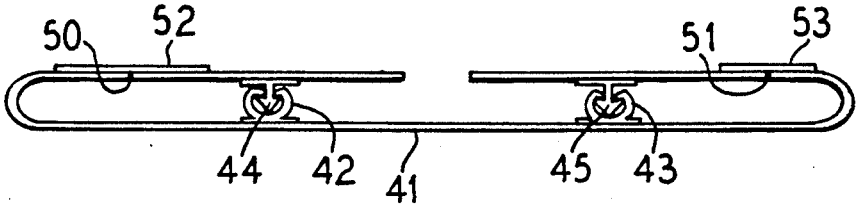
FIGS. 7 and 8 are end elevational views of the bag film of FIG. 6 illustrating the perforations in different locations and different arrangements for folding the film prior to utilizing the film in a bag.

In FIG. 7 an arrangement is shown wherein the profiles are located similarly to the structure in FIG. 6, with the profiles shown on the film 41, at 42 and 44 for one set of female and male profiles and 43 and 45 for the other set.

Perforate tear lines are shown at 50 and 51 closer to the edge of the film and closer to the outermost profile. These tear lines 50 and 51 are sealed with frangible cap layers 52 and 53.

Figure 8:
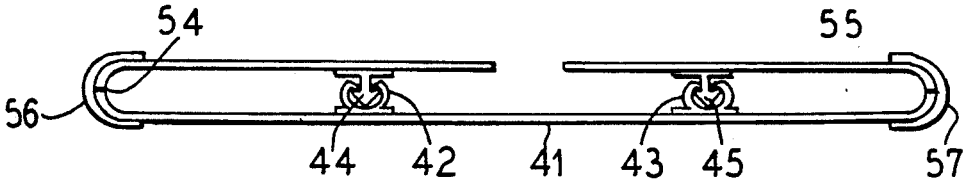

In the structure of FIG. 8, the film 41 is constructed similarly to the films of FIGS. 6 and 7 insofar as the location of the interlocking profiles is concerned. The film, however, has perforate tear lines at 54 and 55 at the location where the film is doubled to bring the profiles into interlocking relationship. Cap layers 56 and 57 are secured over the tear lines 54 and 55. The perforations 54 and 55 will be located equidistant between the mating profiles 42 and 44 and between the profiles 43 and 45.

In each of the arrangements shown in each of the Figures, the frangible cap strip will have a strength less than the film. This is necessary because when the film is to be torn, it must tear along the lines of perforation and simultaneously, the cap strip will tear. By making the cap strip of a strength less than the film, such as by grain orientation or by providing a cap strip which is well adapted for sealing but easily tearable, when the user applies a tearing force to the film along the line of perforations, he must be assured that the film will not tear other than at the perforations.

Various ways of making the film are contemplated, and in the arrangement of FIG. 2, for example, the film is illustrated with separate fastener profiles at 16 and 17 which are cemented or adhered or bonded to the surface of the film. It will be understood that the tear line and cap arrangement may be employed in the type of film shown in FIG. 2, or may be employed in a film wherein the film is extruded with integral plastic profiles.

Figure 9:
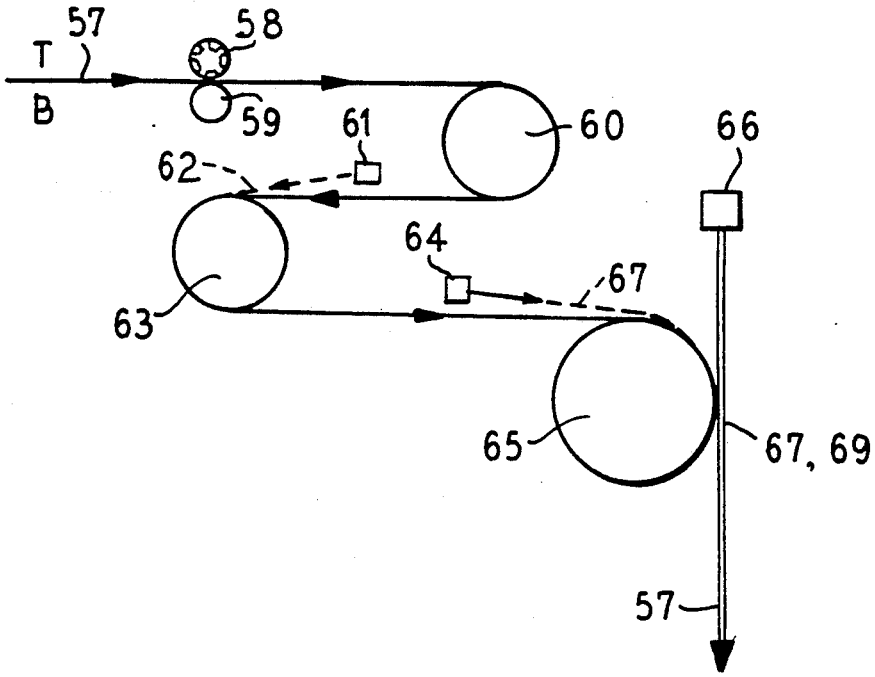
FIG. 9 is an elevational schematic view illustrating a mechanism and method for making the bag film in a single manufacturing operations.

In the arrangement of FIG. 9, the film is formed with the profiles being freshly extruded and adhered to the surface of the film while in the tacky semi-molten plastic state.

A film is shown at 57 fed forwardly in the direction of the arrowed line. One surface of the film is marked T for the top and the other B for the bottom line for ease of reference. The film is first fed through a disk perforator having a lower supporting roll 59 and an upper cutting perforating roll 58. As the film passes through the perforators 58 and 59, closely spaced holes are cut through the film to form a tear line. While one set of perforators are shown, it will be understood that a spaced pair of perforators may be employed so as to provide dual lines of perforation as shown in FIGS. 2 and 3. While the perforator disk 58 may be principally formed of a mechanical knife-like cutter, other forms of perforators such as those using electronic energy may be used.

The perforate film is then passed down over a turning roll 60 to be fed onto a roll 63. As the film 57 is laid onto the turning roll 63, a cap layer extruder die 61 extrudes a layer 62 of cap material onto the surface of the plastic film 57 to which it adheres. The cap layer is of a thin material capable of sealing the perforations against air and moisture permeability and preferably is grain oriented so as to tear easily when the bag film is torn along the perforations. The cap layer is a thin lightweight still warm plastic as it is laid on the film 57 on the roll 63 so that its innate tackiness will cause it to cement itself to the surface of the film.

The film 57 then passes over the roll 63 and is fed onto a roll 65 where a first fastener profile 67 is laid onto the film. The profile 67 is freshly extruded from a die 64 which produces a shaped male profile. The male profile 67 exudes from the die in a warm plastic tacky state so that it mounts onto and adheres firmly to the top surface of the film 57. As the film is fed downwardly onto a roll 65, a second continuous profile 69 is fed onto the surface of the film 57. The profile 69 is extruded from an orifice die 66 and is in the warm tacky state so it will adhere and mount itself onto the film surface.

Thus, in a single pass with the mechanism shown in FIG. 9, the material has been perforated, a cap layer placed over the perforations, and the profiles attached to the film thus completing the film for its use in the formation of a bag.

By extruding a cap strip from the die 61 and placing it on the film in the molten state, it forms a superior bond and seal over the perforations in the film. The still plastic warm soft nature of the layer 62 will not only adhere to the surface of the film but will settle into the openings of the perforations insuring complete sealing. In turning over the roll 63, the cap layer will be sufficiently attached to the film to adhere thereto and begin to solidify so that a firm bond is made between the cap strip and the layer of film. The cap layer is on the lower surface of the film and is pressed further more tightly to the film when the cap layer is pressed to the film as it passes over the roll 65. At the roll 65, the cap layer is captured between the layer of film and the roll surface.

Thus, it will be seen that we have provided an improved bag structure and method and mechanism for making which meets the objectives and advantages above set forth and which provide a new bag structure which can be made in an economical and expedient fashion.

We claim as our invention:

1. A plastic film sheet for use in forming a reclosable container, comprising in combination: a thin plastic film having mating interlocking
profiles on the surface thereof; a line of tear perforations extending along the
film parallel to the profiles and penetrating the film;
and a sealing frangible cap strip overlaid on the area of the perforations providing an impervious seal preventing the passage of air and moisture through the perforations, said strip being of a strength less than the film so that the film will tear along the perforations and the cap strip will separate along its length with the tearing of the film.

2. A plastic film sheet for use in forming a reclosable container constructed in accordance with claim 1:
wherein the frangible cap strip is laid over the area of perforations on the same surface as the mating interlocking profiles.

3. A plastic film sheet for use in forming a reclosable container constructed in accordance with claim 1:
wherein the frangible cap strip is laid over the film surface on the side opposite the location of the mating interlocking profiles.

4. A plastic film sheet for use in forming a reclosable container constructed in accordance with claim 1:
wherein said line of tear perforations is spaced equidistant between the profiles.

5. A plastic film sheet for use in forming a reclosable container constructed in accordance with claim 1:
wherein the line of tear perforations is positioned closer to one profile than to the other.

6. A plastic film sheet for use in forming reclosable containers, comprising in combination:
a thin plastic film having a first pair of mating interlocking profiles extending parallel to a lateral edge thereof;
a second pair of mating interlocking profiles positioned along an opposite lateral edge spaced therefrom a distance substantially equal to the spacing of the first pair of profiles from the first edge;
a first and second line of tear perforations extending parallel to the profiles with one line extending between the first pair of profiles and the other line extending between the second pair of profiles;
and first and second sealing frangible cap strips overlaid respectively on each of the lines of tear perforations providing an impervious seal preventing the passage of air and moisture through the perforations, said strips being of a strength less than the film so that the film would tear along the perforations and the cap strip will separate with the tearing of the film.

7. A plastic film sheet for use in forming reclosable containers constructed in accordance with claim 6:
wherein each line of tear perforations is located equidistant between the mating profiles.

8. A plastic film sheet for use in forming reclosable containers constructed in accordance with claim 6:
wherein each line of tear perforations is located closer to one of its pair of profiles than to the other.

9. A plastic film sheet for use in forming reclosable containers constructed in accordance with claim 6:
wherein each line of tear perforations is located closer to the profile adjacent the edge of the sheet.

10. The method of making a plastic film sheet for use in forming a reclosable container comprising the steps:
providing a sheet of thin plastic container film;
forming a line of perforations longitudinally along the sheet and penetrating the sheet;
and adhering a cap layer of frangible sealing material to the surface of the sheet sealing the perforations with the cap layer having a tear strength less than the film sheet so that the film sheet will tear along the perforations while tearing the sealing material.

11. The method of making a plastic film sheet for use in forming a reclosable container in accordance with the steps of claim 10:
wherein the cap layer is adhered with a heat bond over the container film.

12. The method of making a plastic film sheet for use in forming a reclosable container comprising the steps:
feeding a continuous sheet of thin plastic container film along a path;
forming film penetrating perforations in said film as it is fed along a path to provide a continuous tear line therealong;
continuously feeding a cap strip layer of sealing material onto the surface of the film aligned with the line of perforations to cover and seal the perforations with the cap strip having a tear strength less than the film sheet.

13. The method of making a plastic film sheet for use in forming a reclosable container in accordance with the steps of claim 12:
wherein the cap strip is formed by heat extruding the cap layer onto the film so that the cap strip will be tacky and will heat bond onto the surface of the film.

14. The method of making a plastic film sheet for use in forming a reclosable container in accordance with the steps of claim 12:
including feeding a shaped interlocking profile onto the film and bonding the profile to the film in a predetermined position relative to the line of perforation.

15. The method of making a plastic film sheet for use in forming a reclosable container in accordance with the steps of claim 14:
including feeding a second profile complementary shaped to the first profile onto the film and bonding it thereto in a spaced predetermined position relative to the first profile and in a location straddling and on the opposite side of the line of perforation.

16. The method of making a plastic film sheet for use in forming a reclosable container in accordance with the steps of claim 14:
wherein the profile is formed by a plastic extrusion head and the profile is supplied onto the film while warm and tacky so that it will adhere to the surface thereof.

17. The method of making a plastic film sheet for use in forming a reclosable container in accordance with the steps of claim 15:

including feeding said profiles from extrusion heads onto the film while the plastic is warm and tacky and will adhere to the surface of the film.

18. The method of making a plastic film sheet for use in forming a reclosable container comprising the steps:

providing a thin plastic film having mating interlocking profiles on the surface thereof;

forming a line of tear perforations extending along the film parallel to the profiles and penetrating the film;

and applying a sealing frangible cap strip overlaid on the area of the perforations providing an impervious seal preventing the passage of air and moisture through the perforations, and strip being of a strength less than the film so that the film will tear along the perforations and the cap strip will separate along its length with the tearing on the film.

19. The method of making a plastic film sheet for use in forming a reclosable container comprising the steps:

providing a thin plastic film having a first pair of mating interlocking profiles extending parallel to a lateral edge thereof;

said film having a second pair of mating interlocking profiles positioned along an opposite lateral edge spaced from a distance substantially equal to the spacing of the first pair of profiles from the first edge;

forming first and second lines of tear perforations in the film extending parallel to the profiles with one line extending between the first pair of profiles and the other line extending between the second pair of profiles;

and applying and adhering to the film first and second frangible cap strips overlaid respectively on each of the lines of tear perforations providing an impervious seal preventing the passage of air and moisture through the perforations, said strips being of a strength less than the film so that the film would tear along the perforations and the cap strip will separate with the tearing of the film.

* * * * *